US005524408A

United States Patent [19]

Richey

[11] Patent Number: 5,524,408

[45] Date of Patent: Jun. 11, 1996

[54] METHOD OF AND SPLICE FOR REPAIRING POLES

[75] Inventor: Enoch Richey, Germantown, Tenn.

[73] Assignee: Memphis Light, Gas & Water Division, Memphis, Tenn.

[21] Appl. No.: 280,965

[22] Filed: Jul. 27, 1994

Related U.S. Application Data

[63] Continuation of Ser. No. 76,677, Jun. 15, 1993, Pat. No. 5,337,469.

[51] Int. Cl.[6] ..... E02D 37/00; E04C 3/32; B23P 7/00

[52] U.S. Cl. ..... 52/514.5; 52/726.4; 29/897.1; 29/897.33

[58] Field of Search ..... 29/401.1, 402.8–402.14, 29/281.1, 281.6, 897.1, 897.33, 897.34; 52/40, 170, 514.5, 726.3, 726.4, 514, 296; 405/216

[56] References Cited

U.S. PATENT DOCUMENTS

| | | | |
|---|---|---|---|
| 3,911,548 | 10/1975 | Perry | 29/402.12 |
| 4,048,779 | 9/1977 | Valenziano et al. | 29/402.12 X |
| 4,543,764 | 10/1985 | Kozikowski | 405/216 |
| 4,644,722 | 2/1987 | Phillips | 52/726.4 X |
| 4,702,057 | 10/1987 | Phillips | 52/514 |
| 4,779,389 | 10/1988 | Landers | 52/170 X |

FOREIGN PATENT DOCUMENTS

| | | | |
|---|---|---|---|
| 26961 | 1/1907 | Austria | 52/296 |

OTHER PUBLICATIONS

Mod/Pole Concrete Modular Replacement Poles "The 1½ Hour Pole Repacement" Interpace Corporation, Nov. 1975.

*Primary Examiner*—Peter Vo
*Attorney, Agent, or Firm*—Millen, White, Zelane, & Branigan

[57] ABSTRACT

A method of repairing utility a pole having a section damaged by an accident or decay includes the steps of severing the utility pole above the location of the damage; removing the section of the utility pole including the damaged portion, and replacing the lower section of the utility pole with a steel stanchion having a platform thereon with a split socket disposed above the platform. The upper section of the utility pole is then laterally slid onto the platform through a window provided by opening the split socket upon removing one of two shells forming the split socket. The split socket is then closed by bolting one shell to the other. A space between the outer surface of the upper section of the utility pole and the inner surface of the split socket is then filled with urethane foam. The stanchion is made of a steel which forms a protective iron oxide coating, which coating is brown in color so as to match the brown color of the utility pole. In a preferred embodiment of the stanchion, the stanchion has a tubular lower portion. The split socket is made of two semicircular shells which are bolted both to one another and to the platform upon which the upper section of the utility pole rests.

14 Claims, 4 Drawing Sheets

METHOD OF AND SPLICE FOR REPAIRING POLES

This is a continuation of application Ser. No. 08/076,677 filed Jun. 15, 1993 now U.S. Pat. No. 5,337,469.

FIELD OF THE INVENTION

The present invention relates to methods of and a splice for repairing poles. More particularly, the present invention relates to methods of and a splice for repairing poles useful in the repair of utility poles, and the like, wherein the poles are damaged by decay or accidents.

BACKGROUND OF THE INVENTION

When a utility pole is damaged as a result of an accident or due to natural causes such as decay, the pole is usually replaced. This tends to be an expensive undertaking because of very high labor costs due to highly skilled personnel as well as the expense of a new pole. The more complicated the pole's attachments, the more expensive it is to replace the pole.

In most cases it has been and still is the practice to replace the entire pole, but utilities are at least considering, and from time to time actually using, repair structures in lieu of replacing poles. One replacement structure is the module pole purchased from a company known as the Sherman Company. The Sherman module pole replacement is very costly due to its design. Moreover, at this time the Sherman replacement is no longer available because the Sherman Company no longer makes the module pole.

The patent literature includes a number of configurations for preparing utility poles but to date and to this inventor's knowledge, no utility companies have adopted these configurations and methods to any substantial extent. The module or pole concept which was available from the Sherman Company requires the pole top to be lifted so as to allow a steel sleeve to be slipped over the pole top section and then lowered onto a concrete butt pole. The steel sleeve is then repositioned in a final position to provide bridging of the transition and filling of the void between the steel sleeve and the pole top section with concrete grout. This assembly must be held for an extended period of time of approximately 45 minutes to 1½ hours to allow setting the grout. The approach available from the Sherman Company is time consuming and difficult as well as not necessarily providing optimal final strength.

Prior art approaches suggested by the patent literature require the use of sleeves which must be slipped over existing pole structure. This requires considerable time and skill and thus considerable expense.

SUMMARY OF THE INVENTION

It is an object of the present invention to provide a new and improved method of and splice for repairing damaged utility poles.

Upon further study of the specification and appended claims, further objects and advantages of this invention will become apparent to those skilled in the art.

In view of this object and other objects the instant invention is directed to a method of repairing in situ a utility pole which has been damaged at an area intermediate its length by accident or decay by severing the pole above the area of damage to divide the pole into an undamaged upper portion and a damaged lower portion and then replacing the damaged lower portion with a stanchion having a platform upon which the undamaged upper portion rests. A split socket on the stanchion is closed to surround the undamaged upper portion after the upper portion of the pole is placed on the platform of the stanchion. The method further comprises filling a space between the split sleeve and undamaged upper portion with a rapidly curing bonding agent which chemically bonds the split socket to the undamaged upper portion.

A splice in accordance with the present invention comprises a stanchion having an upper portion and a lower portion wherein the lower portion is tubular and the upper portion is a split socket divided into sections, at least one of which is removable. Disposed at or proximate the junction of the upper and lower sections of the stanchion is a platform which supports and upper portion of the utility pole. Access to the platform is provided upon removing one section of the split socket. Upon returning the removed section and coupling the removed section to the remaining section, a tube is formed around the upper portion of the pole, which tube is filled with a curable chemical bonding material that fills the space between the pole and now closed split socket.

Preferably, the steel material comprising the stanchion is a weathering steel material which forms a brown iron oxide coating that both protects the surface of the steel stanchion and blends with the brown color of a wooden utility pole.

BRIEF DESCRIPTION OF THE DRAWINGS

Various other objects, features and attendant advantages of the present invention will be more fully appreciated as the same becomes better understood when considered in conjunction with the accompanying drawings, in which like reference characters designate the same or similar parts throughout the several views, and wherein.

DETAILED DESCRIPTION

Figure 1:
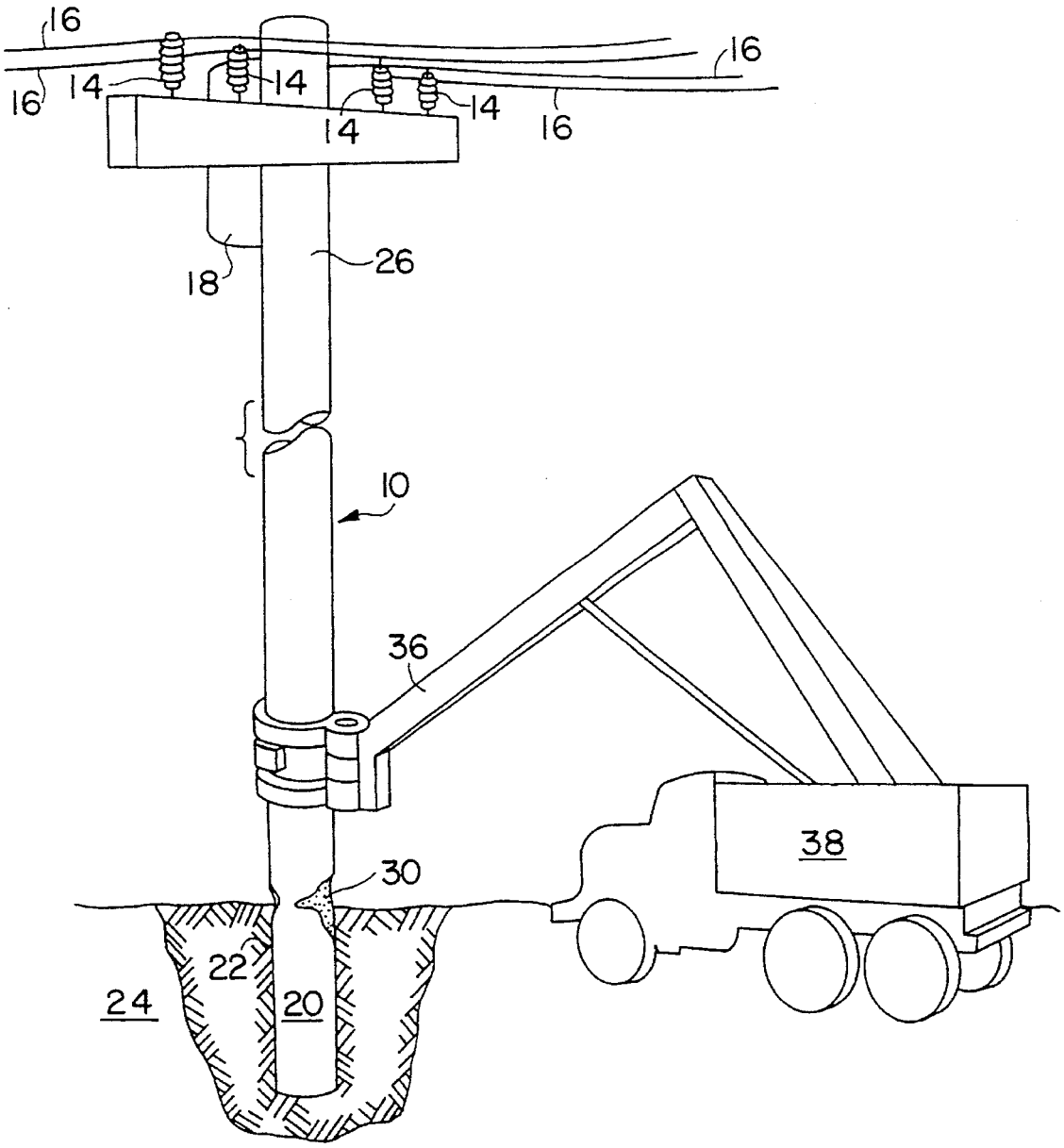
FIG. 1 is a perspective view of a utility pole having a damaged area.

Referring to FIG. 1 there is shown a utility pole 10 having a crossbar 12 with a plurality of insulators 14 thereon that retain utility electric lines 16 and other accessories such as perhaps a transformer 18. The utility pole 10 has a lower portion 20 which is embedded in a hole 22 in the ground 24 and an upper portion 26 to which the crossbar 12 is attached.

In the lower portion 20 of the utility pole 10 a damaged area 30 can occur due to the pole rotting or due to an accident such as an automobile or truck striking the pole 10.

It is expensive and time-consuming to replace the entire pole which requires reattaching electric lines 16 to the insulators 14 and perhaps reinstalling equipment such as transformer 18.

Figure 2:
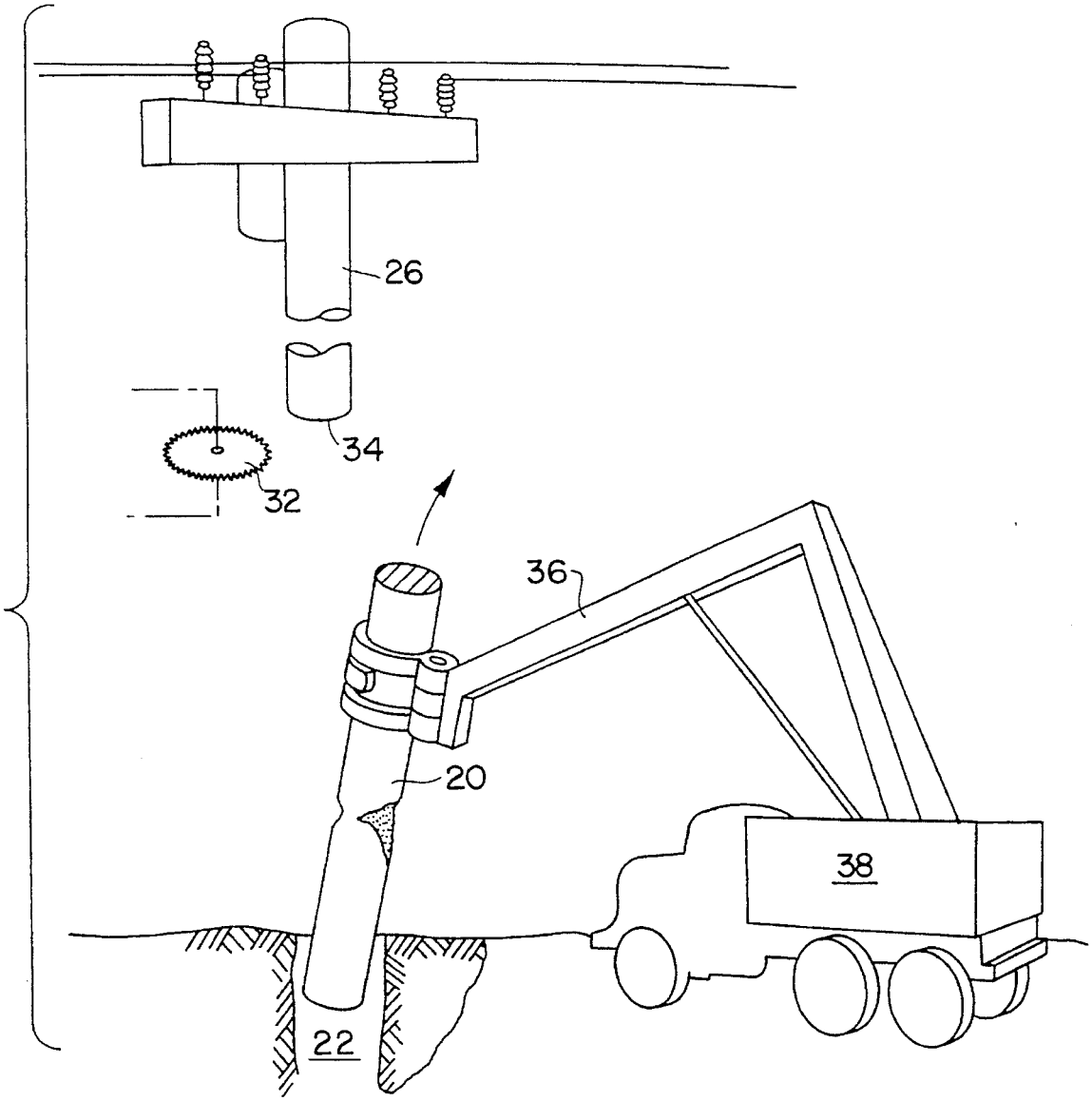
FIG. 2 is a perspective view of a utility truck removing a lower portion of the utility pole of FIG. 1 after the utility pole has been severed.

Referring now to FIG. 2, in practicing the principle of the instant invention, the upper portion 26 of the pole 10 is separated from the lower portion 20 by cutting the pole 10 with a power saw 32 at a location above the damaged area 30 to form a flat bottom surface 34 on the upper portion of the pole. The lower portion 20 of the pole is then extracted from the hole 22 with a hydraulic lift 36 mounted on a utility truck 38.

Figure 3:
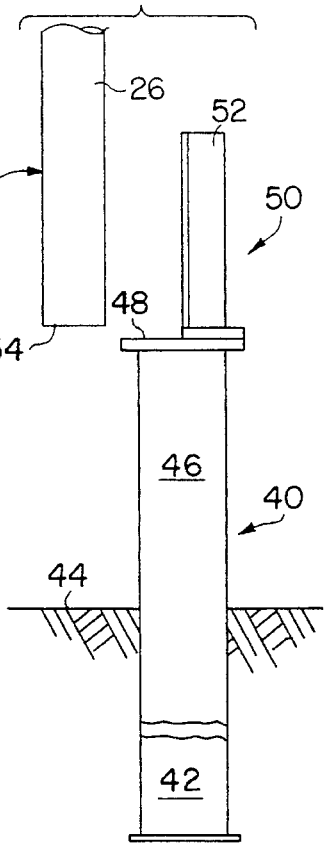
FIG. 3 is a perspective view showing a stanchion of the instant invention installed in the ground through or proximate the hole from which the lower portion of the utility pole has been extracted.
Figure 6:
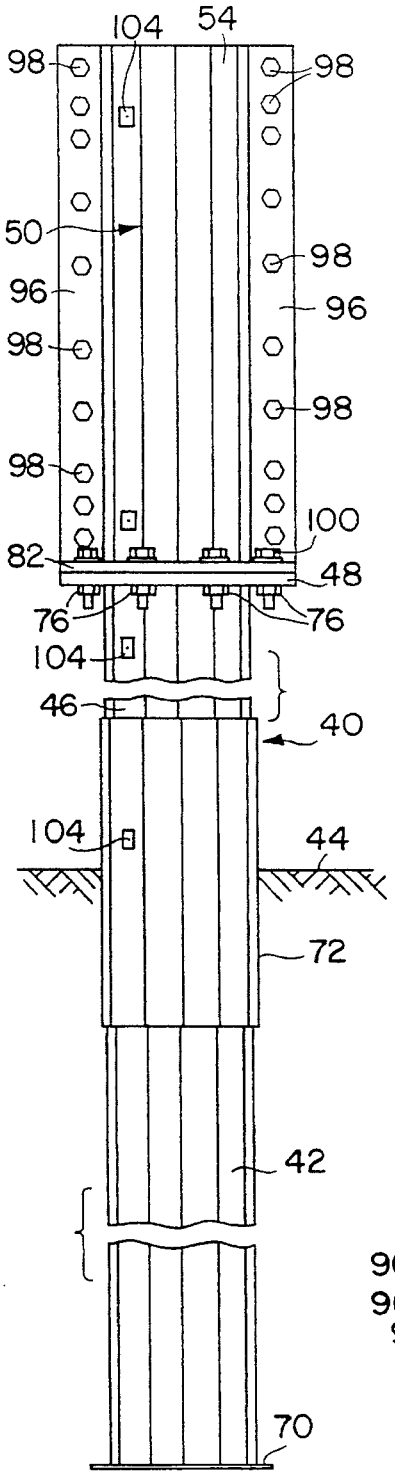
FIG. 6 is a side view of a preferred embodiment of the stanchion used in FIGS. 3–5.
Figure 8:
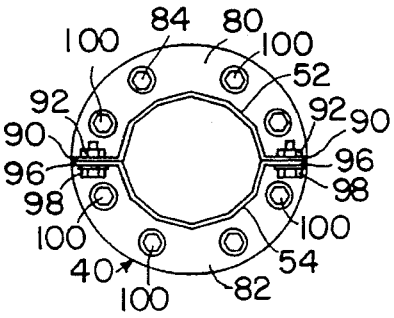
FIG. 8 is a top view of the stanchion of FIG. 6.
Figure 7:
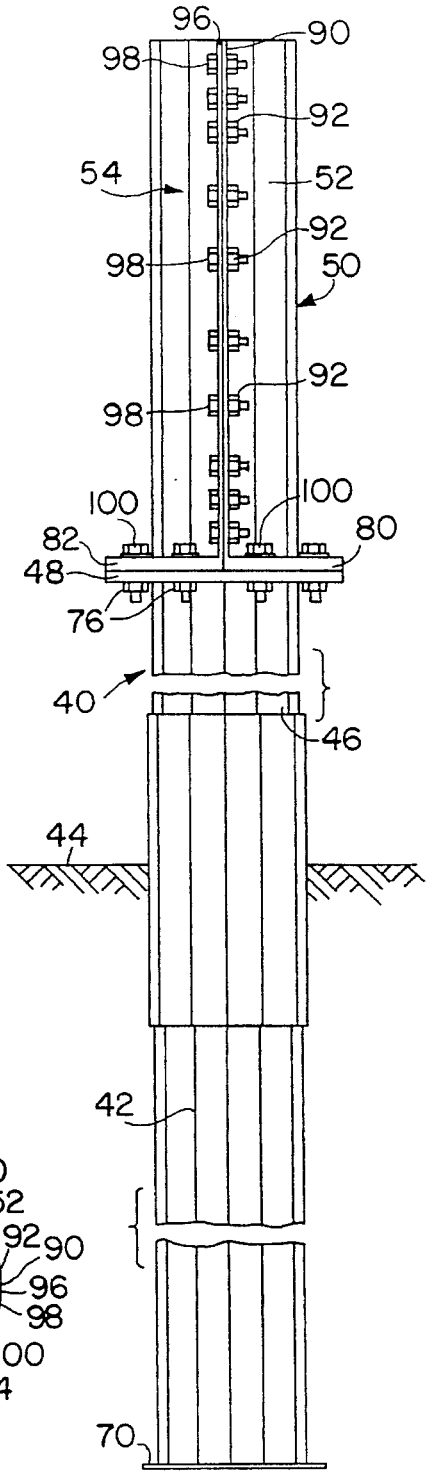
FIG. 7 is a side view of the stanchion of FIG. 6 shown normal to the stanchion of FIG. 6.

Referring now to FIG. 3, a stanchion 40 (see also FIGS. 6, 7 and 8) is inserted into the hole 22 vacated by the lower portion 20 of the telephone pole 10. Stanchion 40 has a buried portion 42 below the ground line 44 and a projecting portion 46 extending above the ground line 44. The stanchion includes a platform 48 above which a split socket 50 is provided. The split socket 50 is formed by a pair of semicircular shells 52 and 54 which are semicircular in the cross-section as will be explained with respect to FIGS. 6–8, are bolted together to form the split socket.

After stanchion 40 is inserted into the ground the upper portion 26 of the utility pole 10 is slid laterally into alignment with the platform 48 so as to rest on the platform 48. This procedure is facilitaed by providing a "window" by displacing the semicircular shell 54 from the semicircular shell 50. The first semicircular shell 50 remains fixed to the lower portion 42 so that of the stanchion 40, the lower portion 26 of the utility pole 10 may be slid laterally onto the platform 48. Consequently, the upper portion 26 of the pole 10 need not be lifted in order to be properly aligned with the lower portion 46 of the stanchion 40. Moreover, since the split socket 50 can be opened to laterally receive the upper end 26 of the pole 10, it is not necessary to slide the socket 50 axially with respect to the upper portion 26 of the pole or to slide the pole axially with respect to the socket.

Figure 5:
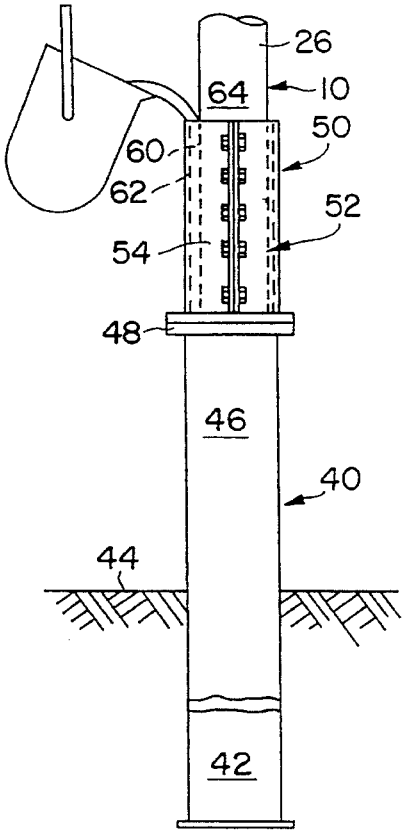
FIG. 5 is a perspective view showing a removed section of the stanchion being replaced to form a tube about the upper portion of the utility pole.

As is seen in FIG. 5, after the lower end 26 of the pole 10 has been rested on the second platform 48, the semicircular shell 54 is bolted to the fixed semicircular shell 50 to provide a tubular socket or enclosure of a fixed dimension and shape having a cross-sectional area greater than the cross-section of the upper section 26 of the utility pole 10.

There is an annular space 60 between the interior wall 62 of the split socket 50 and the exterior surface 64 of the upper portion 26 of the pole 10. The space 60 is filled with an expanding material. The preferred material is a urethane foam which is poured or otherwise dispensed into the space 60. The polyurethane foam expands into cracks and crevices of the pole and adheres to the inner wall 62 of the socket 50 so as to not leave any unfilled voids proximate the surface 64 of the lower portion 26 of pole 10. Approximately 75 percent of the final strength of the bond formed by the polyurethane foam 66 is obtained in 15 minutes or less depending on the outside temperature. Within a few hours the bond reaches its full strength thus allowing the utility crew to release the upper portion 26 of the pole 10 for self support in 15 to 20 minutes.

Referring now more specifically to FIGS. 6, 7 and 8 where a preferred embodiment of the stanchion 40 shown in more detail, it is seen that the stanchion is a tube which in cross-section is a 12-sided polygon providing the stanchion 40 with a corrugated configuration. At the bottom of the lower portion 42 there is a butt plate 70 which is about 17 inches in diameter and 3/16 of an inch thick. The lower portion 42 is coated on the outside with a layer of epoxy 72 approximately 16 mils thick which extends about 2 feet above the ground line 44.

At the top of the lower portion 42 is the platform 48 which is in the form of a circular disk having a diameter greater than the diameter of the lower and upper portions 46 and 50 of the stanchion 40. Plate 48 has a rim portion 74 having a plurality of nuts 76 arrayed therearound in alignment with holes through the disk platform 48.

Figure 4:
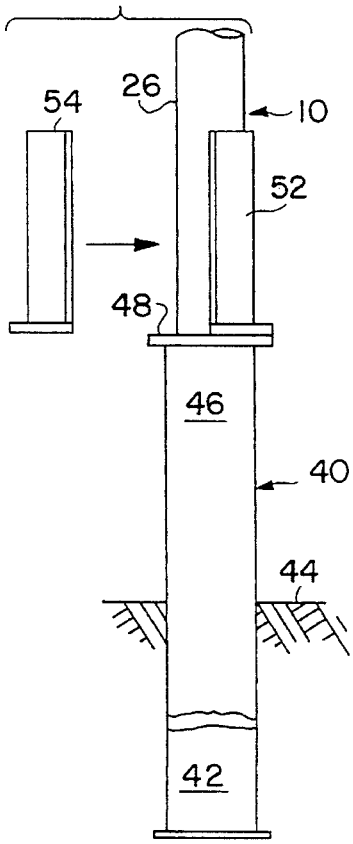
FIG. 4 is a perspective view showing the upper portion of the utility pole being mounted on the stanchion.

The upper portion 50 of the stanchion 40 which is formed as the previously discussed split socket having the semicircular shell 52 and a semicircular shell 54 which have bottom semicircular flanges 80 and 82 respectively. The flange 80 at the bottom of semicircular shell 52 is secured with bolts 84 prior to performing the step of FIG. 4. The flange 80 may be secured at the factory or in situ but it is preferable to have the flange 80 bolted so that the semicircular shell 52 is in place prior to inserting the stanchion 40 into the hole 22.

The shell 52 has a pair of radially projecting flanges 90 extending from opposite sides thereof which each have an array of holes with threaded nuts 92 aligned therewith. The semicircular shell 54 also has a pair of radially projecting flanges, flanges 96 extending therefrom which are abutted with the flanges 90 of semicircular shell 52. Bolts 98 are used to bolt the flanges together by threading with the nuts 92. Finally, the semicircular base flange 82 is bolted to the circular platform 48 by bolts 100 which pass through holes in the semicircular platform 82 aligned with holes in the circular platform 48 so as to thread with the nuts 76 welded to the bottom surface of the platform. As was explained previously, the diameter of the split socket 50 is greater than the diameter of the upper section 26 of the utility pole 10 (see FIGS. 2–5) which it surrounds. This allows a tight fit to be subsequently obtained by filling the space between the hole and the inner wall of the socket with urethane foam.

By way of example, a stanchion 40 used as a pole splice for a class 3 utility pole at a level of about 18 feet from the bottom of the utility pole being replaced has a height from the base 70 of the lower portion 42 to the top of the plate 48 of about 18 feet. About 5½ feet of the stanchion 40 provides the in ground section 42 of the lower portion 46 while the coating 72 has a height of about 7 feet. Typically, the split socket 50 will have a height of about 5 feet. The lower portion 42 tapers slightly from the lower end to the top end while the split sleeve 50 has approximately the same diameter at the bottom as at the top.

Preferably, the stanchion 40 is made of a weathering steel material which rusts to form an iron oxide protective coating providing the stanchion with essentially the same color as a wood telephone pole.

In order to ground the structure a series of nuts or grounding pads 104 are welded to the stanchion 40 so that a grounding wire may be attached to the stanchion if necessary.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A stanchion for repairing a damaged utility pole, having an undamaged top portion the stanchion comprising:

a lower portion and an upper portion with a platform disposed proximate a junction between the lower and upper portions;

the lower portion being a tubular member having a top with the platform disposed thereon and bottom and including a section therebetween for insertion into the ground;

the upper portion being comprised of a rigid one-piece first shell which in use is initially fixed to the lower portion and a rigid one-piece second shell which is detachable from the lower portion and from the first shell to provide a window through which a lower part of a severed undamaged top portion of the utility pole is laterally inserted for resting a bottom of the lower part of the utility pole on the platform, and means for fastening the second shell to the first shell in order to provide enclosure around an outer surface of said lower part of the top portion of the utility pole, the first and second shells being selected to form a tube of a diameter greater than that of the lower part of the severed utility pole with an upwardly facing opening wherein an annular space is provided between the outer surface of said lower part of the utility pole and the enclosure for receiving a mass of hardenable material.

2. The stanchion of claim 1 wherein the stanchion is made of steel, the steel having the property of forming a brown iron oxide protective coating whereby the color of the stanchion matches the color of the wooden utility pole.

3. The stanchion of claim 2 wherein the stanchion is a polygon in cross-section.

4. The stanchion of claim 1 wherein the lower portion of the stanchion is covered with a layer of epoxy extending from the bottom of the lower portion to the location above the ground line.

5. The stanchion of claim 1 wherein the lower portion tapers from the bottom thereof to the top thereof and wherein the upper portion has parallel sides.

6. The stanchion of claim 1 wherein the lower portion of the stanchion has a height of approximately 18 feet and wherein the upper portion has a height of approximately 4 feet.

7. The stanchion of claim 1 wherein the stanchion is made of steel.

8. The stanchion of claim 1 wherein the first and second shells are each substantially semi-circular in cross-section and combine to define the enclosure completely.

9. The stanchion of claim 1, wherein there are only first and second shells which combine to form the enclosure which completely surrounds the pole.

10. The stanchion of claim 9, wherein the cross-section of the enclosure is of a fixed dimension and shape upon securing the first shell to the second shell, the dimension and shape being independent of the diameter of the lower part of the utility pole.

11. The stanchion of claim 10, wherein the first and second shells each have outwardly radially projecting, axially extending flanges which are aligned with one another and fastened together to form the enclosure.

12. The stanchion of claim 11, wherein the shells further include base flanges for bolting to the platform upon which the upper section of the utility pole rests.

13. The stanchion of claim 11, wherein the stanchion is made of steel having the property of forming a brown oxide protective coating.

14. The stanchion of claim 1 further including in combination therewith a quantity of polyurethane foam which expands as it hardens to form the mass of hardenable material.

* * * * *